US008994593B2

(12) United States Patent
Fakharzadeh et al.

(10) Patent No.: US 8,994,593 B2
(45) Date of Patent: Mar. 31, 2015

(54) NEAR-CLOSED POLYGONAL CHAIN MICROSTRIP ANTENNA

(71) Applicants: Mohammad Fakharzadeh, Toronto (CA); Mehrbod Mohajer, Waterloo (CA)

(72) Inventors: Mohammad Fakharzadeh, Toronto (CA); Mehrbod Mohajer, Waterloo (CA)

(73) Assignee: Peraso Technologies, Inc., Toronto (CA)

( * ) Notice: Subject to any disclaimer, the term of this patent is extended or adjusted under 35 U.S.C. 154(b) by 293 days.

(21) Appl. No.: 13/630,553

(22) Filed: Sep. 28, 2012

(65) Prior Publication Data

US 2014/0091979 A1 Apr. 3, 2014

(51) Int. Cl.
*H01Q 1/38* (2006.01)
*H01Q 9/42* (2006.01)
*H01Q 1/36* (2006.01)

(52) U.S. Cl.
CPC ..... *H01Q 9/42* (2013.01); *Y10T 29/49016* (2015.01); *H01Q 1/38* (2013.01); *H01Q 1/36* (2013.01)
USPC ..... 343/700 MS; 343/846; 343/895

(58) Field of Classification Search
CPC ..... H01Q 1/38; H01Q 1/48
USPC ..... 343/700, 846, 848, 895
See application file for complete search history.

(56) References Cited

U.S. PATENT DOCUMENTS

| | | | | | |
|---|---|---|---|---|---|
| 5,313,216 | A * | 5/1994 | Wang et al. | ..... | 343/700 MS |
| 5,450,090 | A * | 9/1995 | Gels et al. | ..... | 343/700 MS |
| 6,008,774 | A * | 12/1999 | Wu | ..... | 343/828 |
| 6,229,487 | B1 * | 5/2001 | Sadler et al. | ..... | 343/700 MS |
| 7,193,565 | B2 * | 3/2007 | Caimi et al. | ..... | 343/700 MS |
| 7,362,283 | B2 * | 4/2008 | Quintero Illera et al. | ..... | 343/846 |
| 2008/0074332 | A1 * | 3/2008 | Arronte et al. | ..... | 343/702 |

OTHER PUBLICATIONS

U.S. Appl. No. 13/340,920, filed Dec. 30, 2011; Mohammad Fakharzadeh Jahromi.
U.S. Appl. No. 13/466,584, filed May 8, 2012; Mohammad Fakharzadeh.

* cited by examiner

*Primary Examiner* — Tho G Phan

(57) ABSTRACT

A microstrip antenna includes a substrate having a first surface and an opposing second surface, a ground plane disposed at the first surface of the dielectric layer, and a conductive layer disposed at the second surface of the substrate. The conductive layer includes a continuous conductive trace comprising a plurality of linear segments arranged in a near-closed polygonal chain. The near-closed polygonal chain can define a truncated square spiral shape. Alternatively, the near-closed polygonal chain can define one of a near-closed pentagonal shape, a near-closed hexagonal shape, a near-closed heptagonal shape, and a near-closed octagonal shape. The antenna can be operated to communicate electromagnetic signaling responsive to current signaling provided by the transceiver circuitry, either by driving electrical current signaling at the microstrip antenna to generate the electromagnetic signaling or by receiving the electromagnetic signaling at the microstrip antenna and converting it to electrical current signaling.

20 Claims, 7 Drawing Sheets

TOTAL GAIN RADIATION PATTERN FOR DIFFERENT φ-PLANES

LEFT-HAND CP RADIATION PATTERN FOR DIFFERENT φ-PLANES

RIGHT-HAND CP RADIATION PATTERN FOR DIFFERENT φ-PLANES

NEAR-CLOSED POLYGONAL CHAIN MICROSTRIP ANTENNA

FIELD OF THE DISCLOSURE

The present disclosure relates generally to antennas and more particularly to microstrip antennas.

BACKGROUND

Cellular telephones, global positioning system (GPS) devices, and other mobile devices often rely on circularly polarized (CP) antennas to provide sufficient gain regardless of axial orientation. Spiral antennas typically are relatively frequency independent and provide a relatively large bandwidth, and thus are a frequently selected design for broadband CP antenna applications. However, at millimeter-wave frequencies, the fabrication tolerances and design rules for trace width and spacing are inconsistent with the finer traces required to implement Archimedean spiral antennas and other such spiral antennas.

BRIEF DESCRIPTION OF THE DRAWINGS

The present disclosure may be better understood, and its numerous features and advantages made apparent to those skilled in the art by referencing the accompanying drawings. The use of the same reference symbols in different drawings indicates similar or identical items.

DETAILED DESCRIPTION

Figure 1:
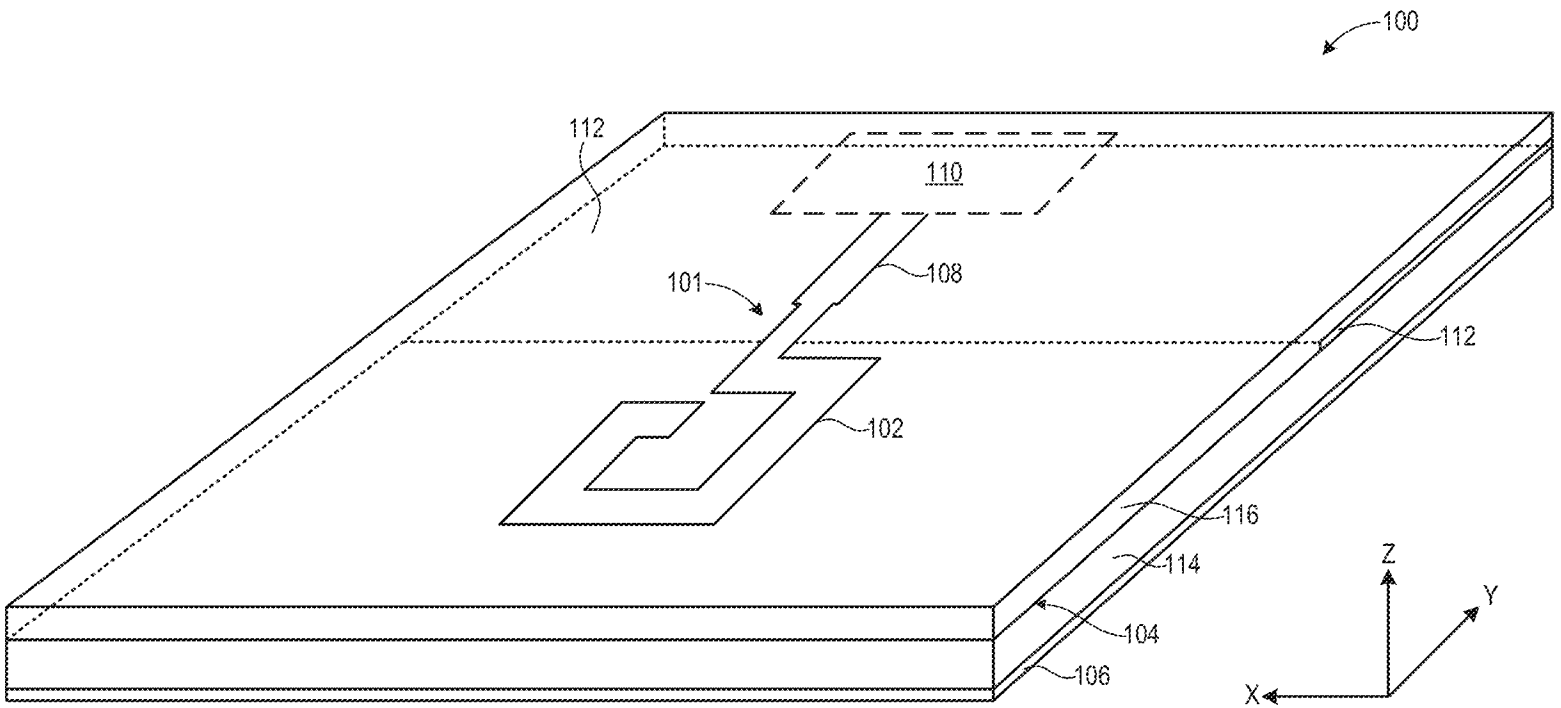
FIG. 1 is a perspective view of an in-package near-closed polygonal chain antenna in accordance with some embodiments of the present disclosure.

The following description is intended to convey a thorough understanding of the present disclosure by providing a number of specific embodiments and details involving the fabrication and use of a circularly polarized (CP) microstrip antenna. It is understood, however, that the present disclosure is not limited to these specific embodiments and details, which are examples only, and the scope of the disclosure is accordingly intended to be limited only by the following claims and equivalents thereof. It is further understood that one possessing ordinary skill in the art, in light of known systems and methods, would appreciate the use of the invention for its intended purposes and benefits in any number of alternative embodiments, depending upon specific design and other needs.

FIGS. 1-8 illustrate example microstrip antennas and methods of their operation and fabrication. In some embodiments, an in-package microstrip antenna includes a substrate having a ground plane disposed at one surface and a conductive layer disposed at the opposing surface, the conductive layer including a radiating element implemented as a continuous conductive trace comprising a plurality of linear segments that define near-closed polygonal chain shape. By implementing a near-closed polygonal chain shape, the design of the radiating element avoids proximate parallel linear segments, and thus avoids the mutual interference that would otherwise result from proximate parallel conductive segments in the radiating element. Moreover, by implementing linear segments, the radiating element can be manufactured for millimeter wave (mm-wave) operation using conventional fabrication tolerances and design rules for trace width and spacing, which typically complicates fabrication of feature sizes of less than 50 micrometers (μm) to 100μm.

In some embodiments, the linear segments of the radiating element form the four corners (with the feed line forming a fifth corner with the first linear segment) that describe a truncated square spiral. The inventors have found that this configuration provides a broad bandwidth and a high degree of circular polarization. Moreover, certain example implementations described herein provide are scaled to operate at a center frequency of approximately 60 gigahertz (GHz), making this configuration particularly well-suited for 60 GHz radio frequency (RF) wireless applications, including those compliant with specifications promulgated by the Wireless Gigabit (WiGig) such as the IEEE 802.1 lad specification. Moreover, the dimensions of these example implementations for this center frequency are within typical IC-package limits, thereby allowing the resulting antenna to be integrated into the same IC package as the circuitry that provides the input/output signals for the antenna. The radiating element may be formed in other near-closed polygonal chain shapes besides a truncated, or incomplete, square spiral, such as in one of a near-closed pentagonal, hexagonal, heptagonal, or octagonal shape.

FIG. 1 illustrates a perspective view of a near-closed polygonal chain microstrip antenna 100 in accordance with some embodiments of the present disclosure. The antenna 100 is implemented on a dielectric substrate, or chip, which may be implemented in a package, individually or with other circuitry. For example, the antenna 100 may be implemented as an in-package antenna for a wireless system on a chip (SOC), whereby the antenna 100 and transceiver circuitry 110 utilizing the antenna 100 are implemented on the same substrate. As another example, the antenna 100 may be implemented as an in-package antenna for a multi-chip module (MCM), whereby the antenna 100 and the transceiver circuitry 110 utilizing the antenna 100 are formed on separate substrates and connected via, for example, wirebonding, flip-chip connections, through-silicon vias, or other inter-chip connection techniques. Such packages may be implemented in any of a variety of wireless devices, such as mobile phones, notebook computers, tablet computers, game consoles, televisions, multimedia receivers, GPS units, and the like.

The antenna 100 may be operated to communicate electromagnetic signaling on behalf of the transceiver circuitry 110. The communication of electromagnetic signaling can include wirelessly transmitting signaling (that is, the transceiver 110 driving electrical current signaling at the microstrip antenna to generate the electromagnetic wirelessly receiving signaling (that is, receiving the electromagnetic signaling at the microstrip antenna and converting it to electrical current signaling for provision to the transceiver circuitry 110), or both.

In the depicted example, the antenna 100 comprises a conductive layer 101 implementing a radiating element 102 disposed at a top surface of a substrate 104, and a ground plane 106 disposed at an opposing bottom surface of the substrate 104 ("top" and "bottom" being relative to the orientation of the view of FIG. 1). The conductive layer 101 further includes a feed line 108 that electrically couples the radiating element 102 to the transceiver circuitry 110, which, as noted above, may be implemented on the same substrate 104 or on a separate substrate. The antenna 100 further may include a feed line ground plane 112 disposed between layers of the substrate 104, whereby the feed line ground plane 112 extends parallel with at least a portion of the feed line 108 so as to suppress EM radiation or resonance by the feed line 108.

The substrate 104 can comprise any of a variety of dielectric materials, or combinations thereof, including, but not limited to, polytetrafluoroethylene, FR-4, FR-1, CEM-1, CEM-3, Arlon 25N, GETEK, liquid crystal polymer (LCP), ceramics, Teflon, and the like. To illustrate, the substrate 104 may be fabricated from multiple printed circuit board (PCB) layers aligned in the Z-plane and bonded using adhesive, heat, and pressure. In the illustrated example, the substrate 104 includes a bottom layer 114 and a top layer 116, whereby the ground plane 106 is disposed at the bottom surface of the bottom layer 114 and the radiating element 102 and feed line 108 are disposed at the top surface of the top layer 116. The feed line ground plane 112 may be positioned and aligned between the layers 114 and 116 (that is, between the top surface of layer 114 and the bottom surface of layer 116) in the bonding process that forms the substrate 104.

The ground plane 106 and the feed line ground plane 112 (referred to collectively as "ground planes 106 and 112") can comprise layers of any of a variety of conductive materials or combinations thereof. For example, the ground planes 106 and 112 can be implemented as metal sheets or foil bonded to the respective substrate layer surfaces. The ground planes 106 and 112 then may be formed into the specified patterns using any of a variety of etching processes. Alternatively, one or both of the ground planes 106 and 112 may be formed via a metal deposition process or metal plating process and then patterned, if appropriate, using an etching process. The conductive material implemented for the ground planes 106 can include, for example, one or more of copper (Cu), gold (Au), silver (Ag), nickel (Ni), aluminum (Al), and the like.

As with the ground planes, the conductive layer 101 formed in the X-Y plane at the top surface of the substrate can include any of a variety of, and combination of, conductive materials, including copper, gold, aluminum, silver, or nickel, formed using any of a variety of techniques. For example, the conductive layer 101 can be formed by forming, adhering, or otherwise disposing a gold or copper sheet or foil at the top surface and then etching or ablating the copper material to define the dimensions of the feed line 108 and the radiating element 102 as described herein. Alternatively, the conductive layer 101 can be formed via a metal deposition or plating process. For example, the conductive layer 101 can be formed via a copper damascene process.

Figure 2:
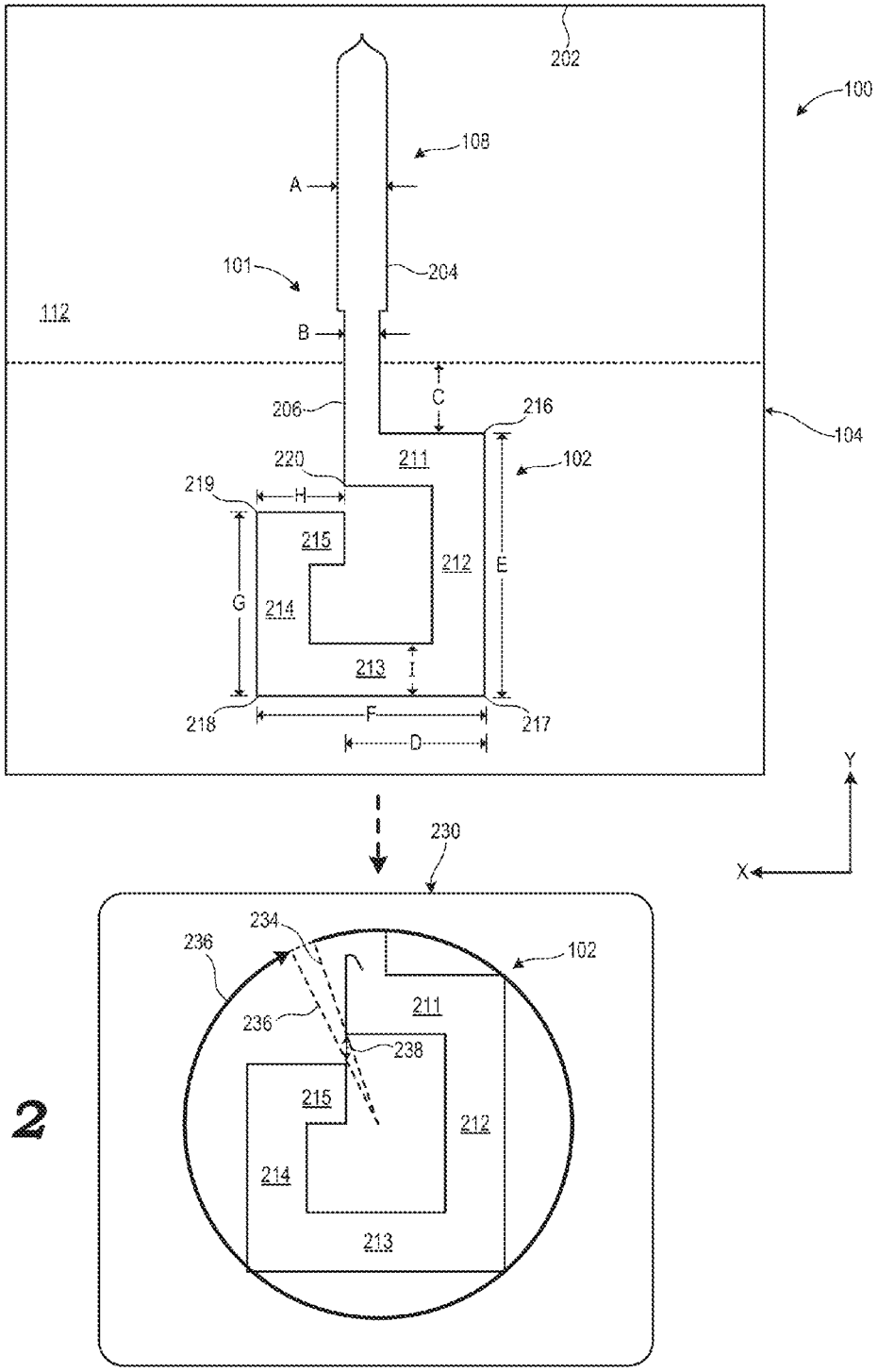
FIG. 2 is a top view of the antenna of FIG. 1 in accordance with some embodiments of the present disclosure.

FIG. 2 illustrates a top-view of the antenna 100. As illustrated, the conductive layer 101 formed at the top surface of the substrate 104 includes the feed line 108 and the radiating element 102. The feed line 108 includes one end proximate to an edge 202 of the substrate 104 and extends therefrom. As shown in FIG. 2, the feed line 108 can include multiple tapered segments, such as a tapered segment 204 having a width A and a tapered segment 206 having a different width B, whereby the widths A and B of the tapered segments 204 and 206 may be selected so as to provide a specified impedance (e.g., 50Ω) for impedance matching purposes, and thus allowing energy at frequencies other than the center frequency of the antenna 100 to be coupled, and thus permitting the feed line 108 to guide signals with a broader bandwidth than a fixed-width feed line.

As noted above, the antenna 100 may employ the feed line ground plane 112 disposed between layers of the substrate 104, whereby the feed line ground plane 112 begins at a position at or near the side 202 of the substrate and extends therefrom. The feed line ground plane 112 acts to suppress radiation/resonance by the feed line 108. However, to avoid interference with the radiating element, the feed line ground plane 112 terminates in the Y-plane prior to the nearest edge of the radiating element 102 (at a distance C from this nearest edge).

The radiating element 102 is implemented as a continuous conductive trace that comprises a plurality of linear segments. For example, in FIG. 2, the radiating element 102 comprises five linear segments 211, 212, 213, 214, and 215 (collectively, "linear segments 211-215") that intersect at their respective segment ends to form four corners 216, 217, 218, and 219 (collectively, "corners 216-219"), with the intersection of the feed line 108 and the linear segment 211 forming a fifth corner 220. In the depicted example, the linear segments 211-215 intersect at right angles (that is, 90 degrees), thereby forming a roughly rectangular shape. As shown in FIG. 2, the linear segment 211 has a length D, the linear segment 212 has a length E, the linear segment 213 has a length F, the linear segment 214 has a length G, and the linear segment 215 have a length H. In this example, linear segment 214 is shorter than linear segment 212 (that is, length G is less than length E), thereby providing the radiating element 102 with a truncated, or incomplete, square spiral shape.

Moreover, in some embodiments, the linear segments 211-215 of the conductive trace forming the radiating element 102 are arranged in a near-closed polygonal chain. The term "near-closed polygonal chain" refers to an open polygonal chain having a sweep of between 270 and 360 degrees (that is, between ¾ of a turn and 1 complete turn) and with vertices at angles of at least 90 degrees. Inset 230 illustrates this aspect for the rectangular configuration shown in FIG. 2. As illustrated, the conductive trace forms an incomplete spiral turn starting at position 232 and ending at position 234 so as to form a sweep 236 of approximately 360 degrees, and whereby each vertex, or corner, is 90 degrees. Thus, no more than a single truncated spiral turn is formed by the conductive trace. By arranging the radiating element 102 into a near-closed polygonal chain, the radiating element 102 is limited to at most one complete turn or sweep, and thereby avoids the placement of parallel linear segments in close proximity to each other. As such, the radiating element 102 can reduce or avoid a mutual coupling effect typically caused by parallel radiating segments in close proximity, which typically is detrimental to antenna operation, particularly at the relatively small dimensions contemplated for the antenna 100.

Moreover, in some embodiments, the continuous conductive trace forming the linear segments 211-215 is fabricated such that the linear segments 211-215 are of an approximately equal, constant width, denoted width I in FIG. 2. For example, in some embodiments the variation of widths of the linear segments 211-215 may be 10% or less, and the width of each linear segment may vary by no more than 10%. As the radiating element 102 is implemented using linear segments of equal constant width, the antenna 100 can be more readily fabricated using conventional fabrication processes than Archimedean microstrip antennas and other spiral antennas, while also being more tolerant of fabrication errors.

Near-closed polygonal chain antennas fabricated in accordance with the teachings herein find particular utilization in mm-wave applications and other extremely high frequency (EHF) applications that also require circular polarization so as to accommodate different angles of orientation, such as in a wireless personal area network (WPAN) environment. Such networks typically operate as line-of-sight and have relatively short ranges (e.g., 10 meters or less). These networks often operate in the 60 GHz band. The inventors have discovered that the antenna 100 of FIGS. 1 and 2 fabricated with approximately the design parameters listed in Table 1 below provides a 60 GHz center-frequency antenna with excellent radiation gain, return loss, and bandwidth characteristics. It will be appreciated by those skilled in the art that the combination of design parameters is just one example set of design parameters, and other design parameters may be implemented to achieve similar results for other implementations using, for example, different substrate thicknesses or materials with different dielectric constants.

TABLE 1

Example Design Parameters for Antenna 100:

| Dimension: | Value: |
|---|---|
| Width A | 0.28 mm |
| Width B | 0.2 mm |
| Distance C | 0.2 mm |
| Length D | 0.8 mm |
| Length E | 1.5 mm |
| Length F | 1.3 mm |
| Length G | 1.05 mm |
| Length H | 0.5 mm |
| Width I | 0.3 mm |
| Length × Width of Ground Plane 106 | 7.4 mm × 12.4 mm |
| Relative Dielectric Constant $\in_r$ of Substrate 104 | 3.5 |
| Thickness of Substrate 104 | 125 um (5 mil) |

FIGS. 3-7 illustrate various operational characteristics of the antenna 100 having the truncated square spiral shape implemented with the design parameters listed in Table 1 above.

Figure 3:
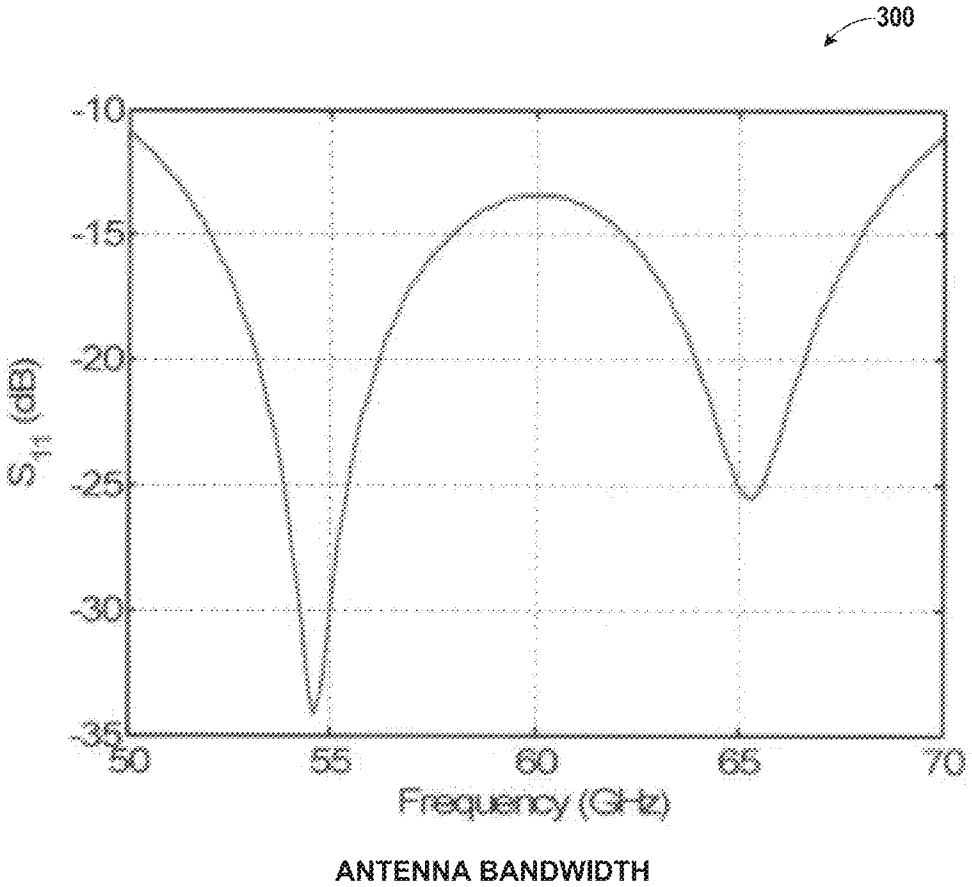
FIG. 3 is a chart illustrating a measured antenna bandwidth of an implementation of the antenna of FIG. 1 in accordance with some embodiments of the present disclosure.

FIG. 3 is a chart illustrating the measured return loss for a sample antenna fabricated in accordance with the design parameters of Table 1. As illustrated by chart 300, the return loss of the antenna is more than 10 decibels (dB) from 50 GHz to 70 GHz, which indicates that the antenna has a bandwidth of at least 20 GHz around a center frequency of approximately 60 GHz.

Figure 4:
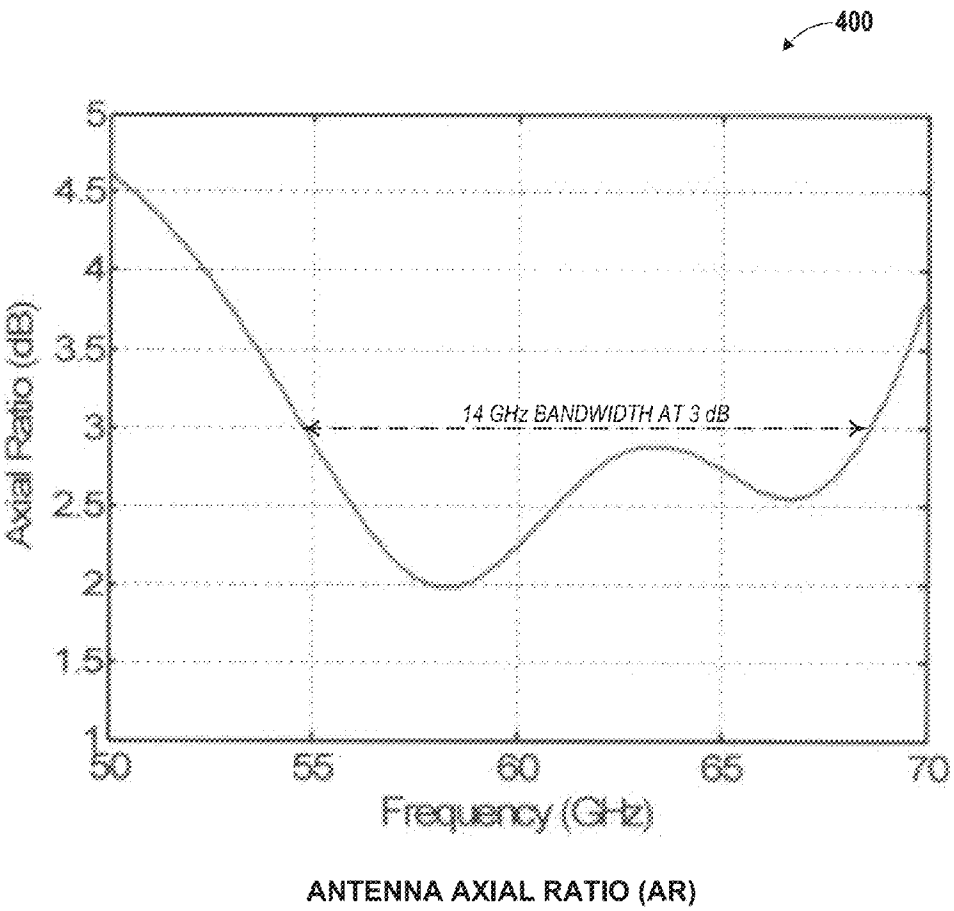
FIG. 4 is a chart illustrating a measured axial rotation of an implementation of the antenna of FIG. 1 in accordance with some embodiments of the present disclosure.

FIG. 4 is a chart 400 illustrating the measured axial ratio for the sample antenna fabricated in accordance with the design parameters of Table 1. The axial ratio of an antenna is a parameter used to evaluate the polarization of the antenna. Typically, an antenna is considered to be circularly polarized at any frequency with an AR below 3 dB. As shown by chart 400, the sample antenna is circularly polarized from approximately 54 GHz to approximately 67 GHz, and thus has a CP bandwidth of approximately 14 GHz around a 60 GHz center frequency.

Figure 5:
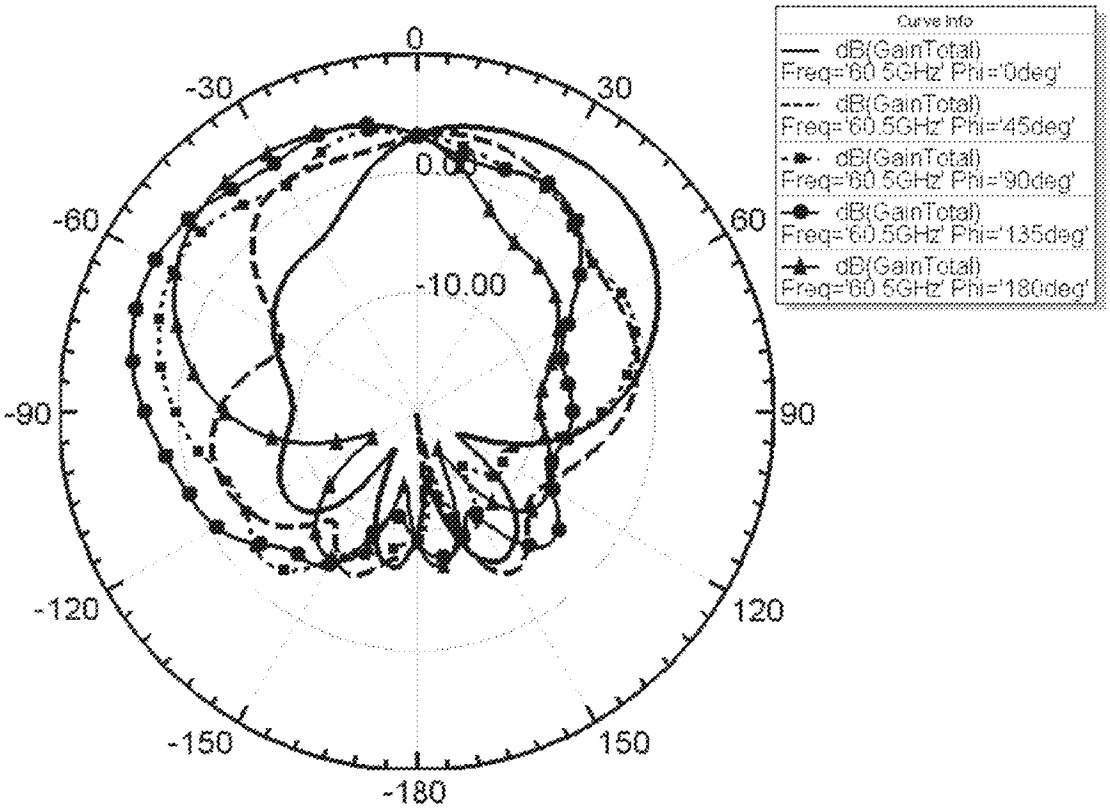
FIG. 5 is a chart illustrating a modeled total gain radiation pattern for different ϕ-planes of an implementation of the antenna of FIG. 1 in accordance with some embodiments of the present disclosure.

FIG. 5 is a chart 500 depicting a polar plot of the total gain radiation patterns for various ϕ-planes for a model of the antenna 100 using the design parameters of Table 1 at a center frequency of 60.5 GHz. As chart 500 illustrates, the antenna has a relatively high front-to-back ratio and a relatively wide beamwidth.

Figure 6:
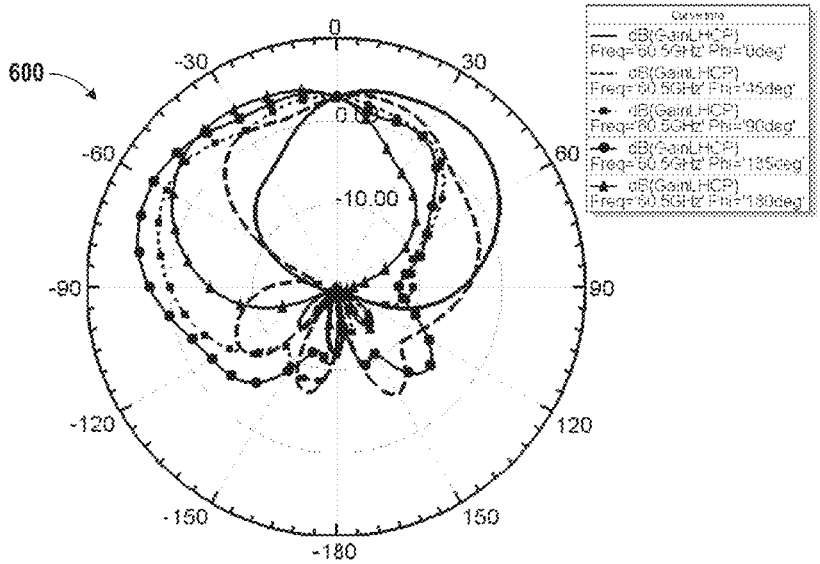
FIG. 6 is a chart illustrating a modeled left-hand circular polarization (CP) radiation pattern for different ϕ-planes of an implementation of the antenna of FIG. 1 in accordance with some embodiments of the present disclosure.
Figure 7:
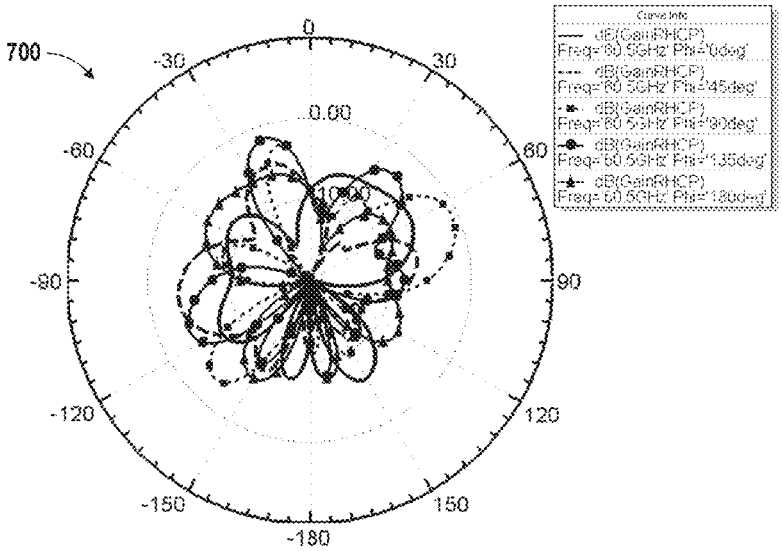
FIG. 7 is a chart illustrating a modeled right-hand CP radiation pattern for different ϕ-planes of an implementation of the antenna of FIG. 1 in accordance with some embodiments of the present disclosure.

FIG. 6 is a chart 600 depicting a polar plot of the left-hand circular polarization (CP) radiation pattern for various ϕ-planes of a model of the antenna 100 using the design parameters of Table 1 at a center frequency of 60.5 GHz, and FIG. 7 is a chart 700 depicting a polar plot of the right-hand. CP pattern for various ϕ-planes of this model.

Figure 8:
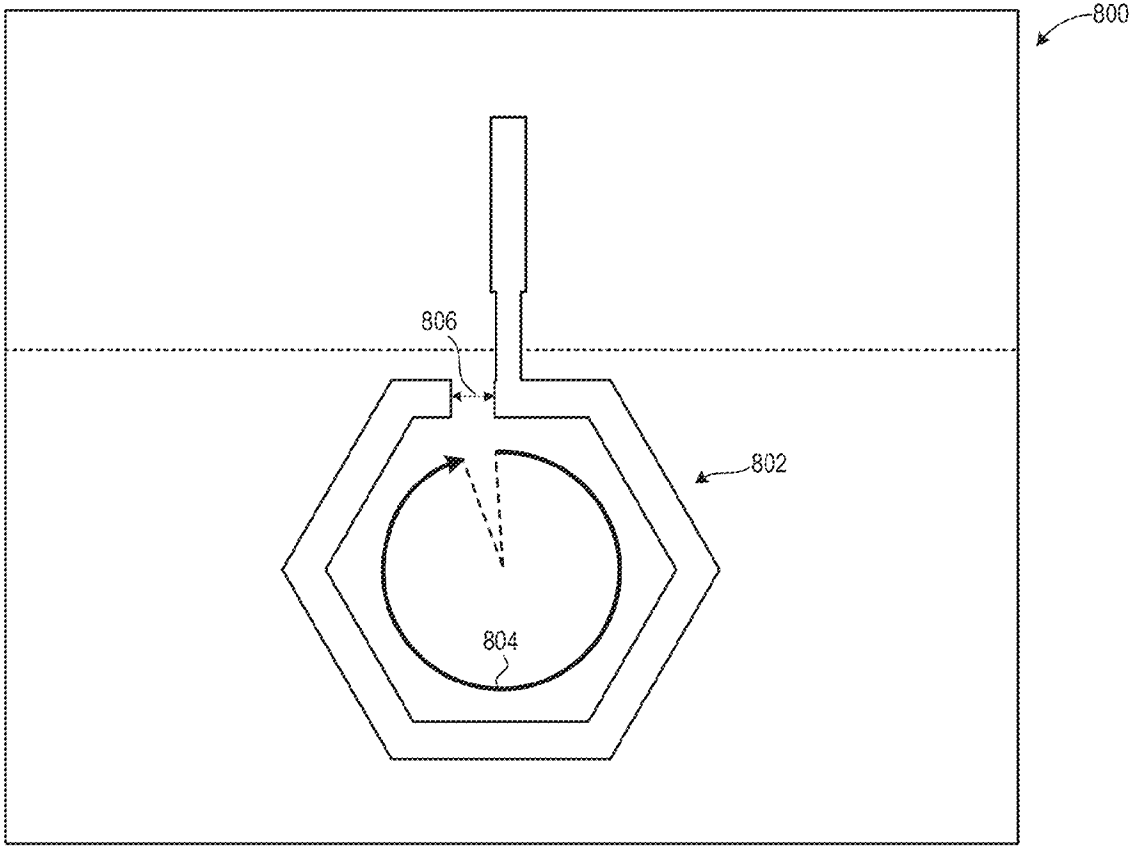
FIG. 8 is a top-view of an alternative implementation of an in-package near-closed polygonal chain antenna in accordance with some embodiments of the present disclosure.

As noted above, although implementations of the near-closed polygonal chain antenna as a truncated square spiral, or rectangular pattern, find beneficial use in mm-wave applications, any of a variety of polygonal shapes may be utilized for the linear segments of the radiating element of an antenna fabricated and used in accordance with the guidelines provided herein. To illustrate, FIG. 8 depicts a top view of an alternative configuration for an in-package antenna 800 having a near-closed polygonal chain radiating element 802 in the shape of a near-closed hexagon having a sweep 804 of greater than 270 degrees, vertices having angles of 120 degrees, and the end of the radiating element 802 within a relatively short distance 806 of the start of the radiating element 802. In other embodiments, the near-closed polygonal chain shape may take the form of, for example, other polygon shapes, such as a near-closed pentagon, heptagon, octagon, and the like. Moreover, although FIGS. 1, 2, and 8 illustrate embodiments whereby the linear segments of the near-closed polygon shape form corners of equal angles, in other embodiments the angles formed by the linear segments may be unequal.

In accordance with one embodiment of the present disclosure, a microstrip antenna includes a dielectric substrate having a first surface and an opposing second surface, a first ground plane disposed at the first surface of the substrate, and a conductive layer disposed at the second surface of the substrate, the conductive layer comprising a continuous conductive trace comprising a plurality of linear segments arranged in a near-closed polygonal chain. In one embodiment, the microstrip antenna is circularly polarized and the linear segments have substantially constant, equal widths. In one embodiment, the conductive layer further includes a tapered feed line conductively coupled to the continuous conductive trace, and a second ground plane disposed between a first layer and a second layer of the substrate, the second ground plane extending parallel with the feed line and terminating prior to the continuous conductive trace. The near-closed polygonal chain may define, for example, one of a near-closed pentagonal shape, a near-closed hexagonal shape, a near-closed heptagonal shape, and a near-closed octagonal shape.

In one embodiment, the plurality of linear segments define a plurality of right-angle corners. In this case, the near-closed polygonal chain may define a truncated square spiral shape. In one such implementation, the continuous conductive trace includes: a first linear segment having a first end and a second end, the first end coupled to an end of a feed line, the first linear segment being substantially perpendicular to the feed line; a second linear segment having a third end and a fourth end, the third end coupled to the second end, the second linear segment being substantially parallel to the feed line; a third linear segment having a fifth end and a sixth end, the fifth end coupled to the fourth end, the third linear segment being substantially perpendicular to the feed line; a fourth linear segment having a seventh end and an eight end, the seventh end coupled to the sixth end, the fourth linear segment being substantially parallel to the feed line; and a fifth linear segment having a ninth end and a tenth end, the ninth end coupled to the eight end, the fifth linear segment being substantially perpendicular to the feed line. The first linear segment may have a length of approximately 0.8 millimeters; the second linear segment may have a length of approximately 1.5 millimeters; the third linear segment may have a length of approximately 1.3 millimeters; the fourth linear segment may have a length of approximately 1.05 millimeters; the fifth linear segment may have a length of approximately 0.5 millimeters; and the first, second, third, fourth, and fifth linear segments each may have a substantially constant width of approximately 0.3 millimeters. In this implementation, the microstrip antenna may have a center frequency of approximately 60 gigahertz.

In accordance with another aspect of the present disclosure, a method of operating microstrip antenna includes providing the microstrip antenna comprising a substrate having a first surface and an opposing second surface, a ground plane disposed at the first surface of the substrate, and a conductive layer disposed at the second surface of the substrate, the conductive layer comprising a continuous conductive trace comprising a plurality of linear segments arranged in a near-closed polygonal chain. The method further includes communicating electromagnetic signaling via the microstrip antenna. Communicating electromagnetic signaling can include at least one of: driving a current at the microstrip antenna to generate the electromagnetic signaling; and receiving the electromagnetic signaling at the microstrip antenna. In one embodiment, the microstrip antenna has a center frequency of approximately 60 gigahertz.

In accordance with yet another aspect of the present disclosure, a method of fabricating a microstrip antenna includes providing a substrate having a first ground plane at a first surface of the substrate, and providing, at a second surface of the substrate opposite the first surface, a conductive layer comprising a continuous conductive trace comprising a plurality of linear segments arranged in a near-closed polygonal chain. The method further can include providing a tapered feed line conductively coupled to the continuous conductive trace and providing a second ground plane disposed between a first layer and a second layer of the substrate, the second ground plane extending parallel with the feed line and terminating prior to the continuous conductive trace. In one embodiment, providing the conductive layer comprises patterning the continuous conductive trace to define a truncated square spiral shape. In another embodiment, providing the conductive layer comprises patterning the continuous conductive trace to define one of a near-closed pentagonal shape, a near-closed hexagonal shape, a near-closed heptagonal shape, and a near-closed octagonal shape.

In one implementation, providing the conductive layer includes patterning the continuous conductive trace to include: a first linear segment having a first end and a second end, the first end coupled to an end of a feed line, the first linear segment being substantially perpendicular to the feed line; a second linear segment having a third end and a fourth end, the third end coupled to the second end, the second linear segment being substantially parallel to the feed line; a third linear segment having a fifth end and a sixth end, the fifth end coupled to the fourth end, the third linear segment being substantially perpendicular to the teed line; a fourth linear segment having a seventh end and an eight end, the seventh end coupled to the sixth end, the fourth linear segment being substantially parallel to the feed line; and a fifth linear segment having a ninth end and a tenth end, the ninth end coupled to the eight end, the fifth linear segment being substantially perpendicular to the feed line. In this instance, patterning the continuous conductive trace can include patterning the continuous conductive trace so that: the first linear segment has a length of approximately 0.8 millimeters; the second linear segment has a length of approximately 1.5 millimeters; the third linear segment has a length of approximately 1.3 millimeters; the fourth linear segment has a length of approximately 1.05 millimeters; the fifth linear segment has a length of approximately 0.5 millimeters; and the first, second, third, fourth, and fifth linear segments each has a substantially constant width of approximately 0.3 millimeters. In this instance, the microstrip antenna can have a center frequency of approximately 60 gigahertz.

In this document, relational terms such as first and second, and the like, may be used solely to distinguish one entity or action from another entity or action without necessarily requiring or implying any actual such relationship or order between such entities or actions. The terms "comprises," "comprising," or any other variation thereof, are intended to cover a non-exclusive inclusion, such that a process, method, article, or apparatus that comprises a list of elements does not include only those elements but may include other elements not expressly listed or inherent to such process, method, article, or apparatus. An element preceded by "comprises . . . a" does not, without more constraints, preclude the existence of additional identical elements in the process, method, article, or apparatus that comprises the element. The term "another", as used herein, is defined as at least a second or more. The terms "including" and/or "having", as used herein, are defined as comprising. The term "coupled", as used herein with reference to electro-optical technology, is defined as connected, although not necessarily directly, and not necessarily mechanically.

The specification and drawings should be considered as examples only, and the scope of the disclosure is accordingly intended to be limited only by the following claims and equivalents thereof. Note that not all of the activities or elements described above in the general description are required, that a portion of a specific activity or device may not be required, and that one or more further activities may be performed, or elements included, in addition to those described. Still further, the order in which activities are listed are not necessarily the order in which they are performed. Also, the concepts have been described with reference to specific embodiments. However, one of ordinary skill in the art appreciates that various modifications and changes can be made without departing from the scope of the present disclosure as set forth in the claims below. Accordingly, the specification and figures are to be regarded in an illustrative rather than a restrictive sense, and all such modifications are intended to be included within the scope of the present disclosure.

Benefits, other advantages, and solutions to problems have been described above with regard to specific embodiments. However, the benefits, advantages, solutions to problems, and any feature(s) that may cause any benefit, advantage, or solution to occur or become more pronounced are not to be construed as a critical, required, or essential feature of any or all the claims.

What is claimed is:

1. A microstrip antenna comprising:

a dielectric substrate having a first surface and an opposing second surface;

a first ground plane disposed at the first surface of the substrate; and a conductive layer disposed at the second surface of the substrate, the conductive layer comprising:

a continuous conductive trace comprising a plurality of linear segments arranged in a near-closed polygonal chain;

a tapered feed line conductively coupled to the continuous conductive trace; and a second ground plane disposed between a first layer and a second layer of the substrate, the second ground plane extending parallel with the feed line and terminating prior to the continuous conductive trace.

2. The microstrip antenna of claim 1, wherein the microstrip antenna is circularly polarized.

3. The microstrip antenna of claim 1, wherein the near-closed polygonal chain defines one of a near-closed pentagonal shape, a near-closed hexagonal shape, a near-closed heptagonal shape, and a near-closed octagonal shape.

4. The microstrip antenna of claim 1, wherein the plurality of linear segments define a plurality of right-angle corners.

5. The microstrip antenna of claim 4, wherein the near-closed polygonal chain defines a truncated square spiral shape.

6. A microstrip antenna comprising:

a dielectric substrate having a first surface and an opposing second surface;

a first ground plane disposed at the first surface of the substrate; and a conductive layer disposed at the second surface of the substrate, the conductive layer comprising a continuous conductive trace comprising a plurality of linear segments arranged in a near-closed polygonal chain, wherein the linear segments have substantially constant, equal widths.

7. The microstrip antenna of claim 6, wherein the conductive layer further comprises:

a tapered feed line conductively coupled to the continuous conductive trace; and a second ground plane disposed between a first layer and a second layer of the substrate, the second ground plane extending parallel with the feed line and terminating prior to the continuous conductive trace.

8. The microstrip antenna of claim 6, wherein the microstrip antenna is circularly polarized.

9. The microstrip antenna of claim 6, wherein the near-closed polygonal chain defines one of a near closed truncated square spiral shape, a near-closed pentagonal shape, a near-closed hexagonal shape, a near-closed heptagonal shape, and a near-closed octagonal shape.

10. A microstrip antenna comprising:

a dielectric substrate having a first surface and an opposing second surface;

a first ground plane disposed at the first surface of the substrate; and a conductive layer disposed at the second surface of the substrate, the conductive layer comprising a continuous conductive trace comprising a plurality of linear segments arranged in a near-closed polygonal chain that defines a truncated square spiral shape, and wherein the continuous conductive trace comprises:

a first linear segment having a first end and a second end, the first end coupled to an end of a feed line, the first linear segment being substantially perpendicular to the feed line;

a second linear segment having a third end and a fourth end, the third end coupled to the second end, the second linear segment being substantially parallel to the feed line;

a third linear segment having a fifth end and a sixth end, the fifth end coupled to the fourth end, the third linear segment being substantially perpendicular to the feed line;

a fourth linear segment having a seventh end and an eight end, the seventh end coupled to the sixth end, the fourth linear segment being substantially parallel to the feed line; and a fifth linear segment having a ninth end and a tenth end, the ninth end coupled to the eight end, the fifth linear segment being substantially perpendicular to the feed line.

11. The microstrip antenna of claim 10, wherein:

the first linear segment has a length of approximately 0.8 millimeters;

the second linear segment has a length of approximately 1.5 millimeters;

the third linear segment has a length of approximately 1.3 millimeters;

the fourth linear segment has a length of approximately 1.05 millimeters;

the fifth linear segment has a length of approximately 0.5 millimeters; and the first, second, third, fourth, and fifth linear segments each has a substantially constant width of approximately 0.3 millimeters.

12. The microstrip antenna of claim 11, wherein the microstrip antenna has a center frequency of approximately 60 gigahertz.

13. The microstrip antenna of claim 10, wherein the conductive layer further comprises:

a tapered feed line conductively coupled to the continuous conductive trace; and a second ground plane disposed between a first layer and a second layer of the substrate, the second ground plane extending parallel with the feed line and terminating prior to the continuous conductive trace.

14. The microstrip antenna of claim 10, wherein the microstrip antenna is circularly polarized.

15. A method of fabricating a microstrip antenna, the method comprising;

providing a substrate having a first ground plane at a first surface of the substrate;

providing, at a second surface of the substrate opposite the first surface, a conductive layer comprising a continuous conductive trace comprising a plurality of linear segments arranged in a near-closed polygonal chain;

providing a tapered feed line conductively coupled to the continuous conductive trace; and providing a second ground plane disposed between a first layer and a second layer of the substrate, the second ground plane extending parallel with the feed line and terminating prior to the continuous conductive trace.

16. The method of claim 15, wherein providing the conductive layer comprises patterning the continuous conductive trace to define a truncated square spiral shape.

17. A method of fabricating a microstrip antenna, the method comprising:

providing a substrate having a first ground plane at a first surface of the substrate; and providing, at a second surface of the substrate opposite the first surface a conductive layer comprising a continuous conductive trace comprising a plurality of linear segments arranged in a near-closed polygonal chain, wherein the linear segments have substantially constant, equal widths and wherein the near-closed polygonal chain defines one of a near-closed hexagonal shape, a near-closed heptagonal shape, and a near-closed octagonal shape.

18. A method of fabricating a microstrip antenna, the method comprising:

providing a substrate having a first ground plane at a first surface of the substrate; and providing, at a second surface of the substrate opposite the first surface, a conductive layer comprising a continuous conductive trace comprising a plurality of linear segments arranged in a near-closed polygonal chain, the continuous conductive trace including:

a first linear segment having a first end and a second end, the first end coupled to an end of a feed line, the first linear segment being substantially perpendicular to the feed line;

a second linear segment having a third end and a fourth end, the third end coupled to the second end, the second linear segment being substantially parallel to the feed line;

a third linear segment having a fifth end and a sixth end, the fifth end coupled to the fourth end, the third linear segment being substantially perpendicular to the feed line;

a fourth linear segment having a seventh end and an eight end, the seventh end coupled to the sixth end, the fourth linear segment being substantially parallel to the feed line; and a fifth linear segment having a ninth end and a tenth end, the ninth end coupled to the eight end, the fifth linear segment being substantially perpendicular to the feed line.

19. The method of claim 18, wherein patterning the continuous conductive trace comprises patterning the continuous conductive trace so that:

the first linear segment has a length of approximately 0.8 millimeters;

the second linear segment has a length of approximately 1.5 millimeters;

the third linear segment has a length of approximately 1.3 millimeters;

the fourth linear segment has a length of approximately 1.05 millimeters;

the fifth linear segment has a length of approximately 0.5 millimeters; and the first, second, third, fourth, and fifth linear segments each has a substantially constant width of approximately 0.3 millimeters.

20. The method of claim 19, wherein the microstrip antenna has a center frequency of approximately 60 gigahertz.

* * * * *